US011478064B2

(12) United States Patent
Kennebrew

(10) Patent No.: US 11,478,064 B2
(45) Date of Patent: Oct. 25, 2022

(54) WEAVE ASSIST

(71) Applicant: Courtney J Kennebrew, Union Springs, AL (US)

(72) Inventor: Courtney J Kennebrew, Union Springs, AL (US)

(73) Assignee: Courtney J. Kennebrew, Union Springs, AL (US)

( * ) Notice: Subject to any disclaimer, the term of this patent is extended or adjusted under 35 U.S.C. 154(b) by 183 days.

(21) Appl. No.: 16/653,499

(22) Filed: Oct. 15, 2019

(65) Prior Publication Data

US 2020/0260841 A1 Aug. 20, 2020

Related U.S. Application Data

(60) Provisional application No. 62/838,391, filed on Apr. 25, 2019.

(51) Int. Cl.

| | |
|---|---|
| ***A45D 44/04*** | (2006.01) |
| ***A41G 3/00*** | (2006.01) |
| ***D05C 15/02*** | (2006.01) |
| ***A41G 5/00*** | (2006.01) |

(52) U.S. Cl.

CPC ..... *A45D 44/04* (2013.01); *A41G 3/0066* (2013.01); *A41G 3/0075* (2013.01); *A41G 5/006* (2013.01); *D05C 15/02* (2013.01)

(58) Field of Classification Search

CPC .... A41G 3/0075; A41G 3/0066; A41G 5/006; A41G 3/00; A45D 44/04; A45D 44/14; D05C 15/02; A63H 3/44; A47F 7/065

See application file for complete search history.

(56) References Cited

U.S. PATENT DOCUMENTS

| | | | | |
|---|---|---|---|---|
| 3,603,322 | A * | 9/1971 | Wilson | A45C 11/00 132/315 |
| 3,835,868 | A * | 9/1974 | Heck | A41G 3/0075 132/201 |
| 10,791,818 | B1 * | 10/2020 | Anguiano | A45D 44/14 |
| 2015/0230589 | A1 * | 8/2015 | Davidson | A41G 3/0041 223/66 |

* cited by examiner

*Primary Examiner* — Daniel J Colilla

(57) ABSTRACT

The Weave Assist is an all inclusive flat but slighlty elevated weaving device used by stylist and seamstresses to cut out the stop and start of needle prepping. It is also used to make and correct wig units in a portable all inclusive design that has a simple blade for your cutting needs while prepping or wig making. It also has feet to help the device stay in place while working. The device the has a base, spool, spool holder, storage box, cutting blade, magnet, and half moon holder to attach block bead if not attaching directly to the base. The weave assist allows needle prep for up to 2½ clients. The lifespan of the weave assist is 3-7 years with proper use. The device can eliminate one less step in the weaving process allowing work to process without breaks and complete clients in a timely manner.

7 Claims, 7 Drawing Sheets

WEAVE ASSIST

The present application claims priority to U.S. non-provisional patent application Ser. No. 16/653,499, filed on Oct. 15, 2019. The entire disclosure is included herein in its entirety at least by reference.

BACKGROUND OF THE INVENTION

1. Field of the Invention

The present Invention Is in the field of utility and pertains particularly to methods and apparatus for controlling a The Weave Assist. In the mounting photographs, a board made of wood or suitable material is often used. In preparing to prep the device, thread and block head must be conveniently located for ease of use. The blade is beveled to an appropriate angle to allow for cutting thread, hair wefts, or suitable material. The cutting blade holder Instrument consists of a slightly rounded shape that curves around to form a V shape to house the blade. The material is plastic or suitable material. The cutting device is stationary. The spool holder is made of wood or suitable material used to hold thread on the device. The storage box is also made of wood or suitable materials used to house extra items needed to construct wig units or needle prep. Such a block head for wigs is described in U.S. Pat. No. 3,300,108 and consists of canvas outer layer with suitable filler to make wig units. The cutter blade described in this patent is formed of metal, and is thus lightweight and placed inside the simple device and Is very convenient for users that are left and right handed. In the field of hair care, pertaining to sew-ins and wig making there are no simple ways to efficiently do the process of weaving. Some use styrofoam heads to help with construction and needle storage. Some proprietors use the clients head to construct wig units which is still not efficient to adequately move throughout a day. One advantage of The Weave assist is that it is lightweight and transportable and there is no need to have the client available to use the device. It is all inclusive and fully useful out of the box. Wig units can be made on the weave assist as well as repairs and need prep. The weave assist can constantly be moved in any direction for wig making and needle prep for uniform coverage. The Weave Assist is a time effective way to get your weave installations, wigs units, and seamstress sewing done. It cuts out the Frustration with needle prep, and Gives you the ability to take it anywhere. The Weave Assist is an all inclusive weaving device that's perfect for stylist or seamstresses on the go, it's lightweight, and portable so you can take it anywhere you want to go. It also has a simple blade so there is no need for scissors for needle prep and weft cutting. The weave assist would be a stylist best friend for the following reasons:

1. Ability to have multiple needles threaded at one time
2. Cut out stopping and rethreading during installs
3. All inclusive for what's needed to prepare needles
4. Stylist or seamstress 3rd hand
5. Space saving
6. Simple to use
7. Easy to prep
8. Wig construction and styling
9. Simple Blade
10. Portable
11. Magnet
12. Ribbon bow around the base of the head

SUMMARY OF THE INVENTION

The problem stated above is that adequate and timely actions are needed to complete client installs, wig making, and seamstress work. The design of the weave assist covers all aspects of working smarter not harder. The simple design of the platform, base, head, spool holder, spool base, thread, and storage box were placed with the greatest accessibility in mind for the consumer. Every movement on the weave assist were thought out for a stylist that needed it for daily use. It is a compact unit with everything needed to work on the go or in a designated location. Any flat surface is adequate to work on in a well rd space. All of the functional parts on the weave assist were special made for functionality and efficiency of the device.

Every hair weaver requires sufficient and direct lighting to property construct a unit or prep needles on the weave assist via overhead indoor lighting or sufficient outdoor lighting. In the embodiment of the invention a flat base is provided, comprising a head, storage box, spool, spool holder, and simple blade. Underneath the base is four base feet. The material of the head is high density plastic with high density styrofoam encased in canvas. The spool holder acts as a spindle to unwind thread for prepping needles and wig making. The spool holder is retractable to allow the consumer to replace empty thread spools with new ones. To use the simple blade, consumer pulls thread to desired length, pull taught, and pull through the simple blade to cut the thread.

DESCRIPTION OF THE DRAWING FIGURES

DETAILED DESCRIPTION

Figure 1:
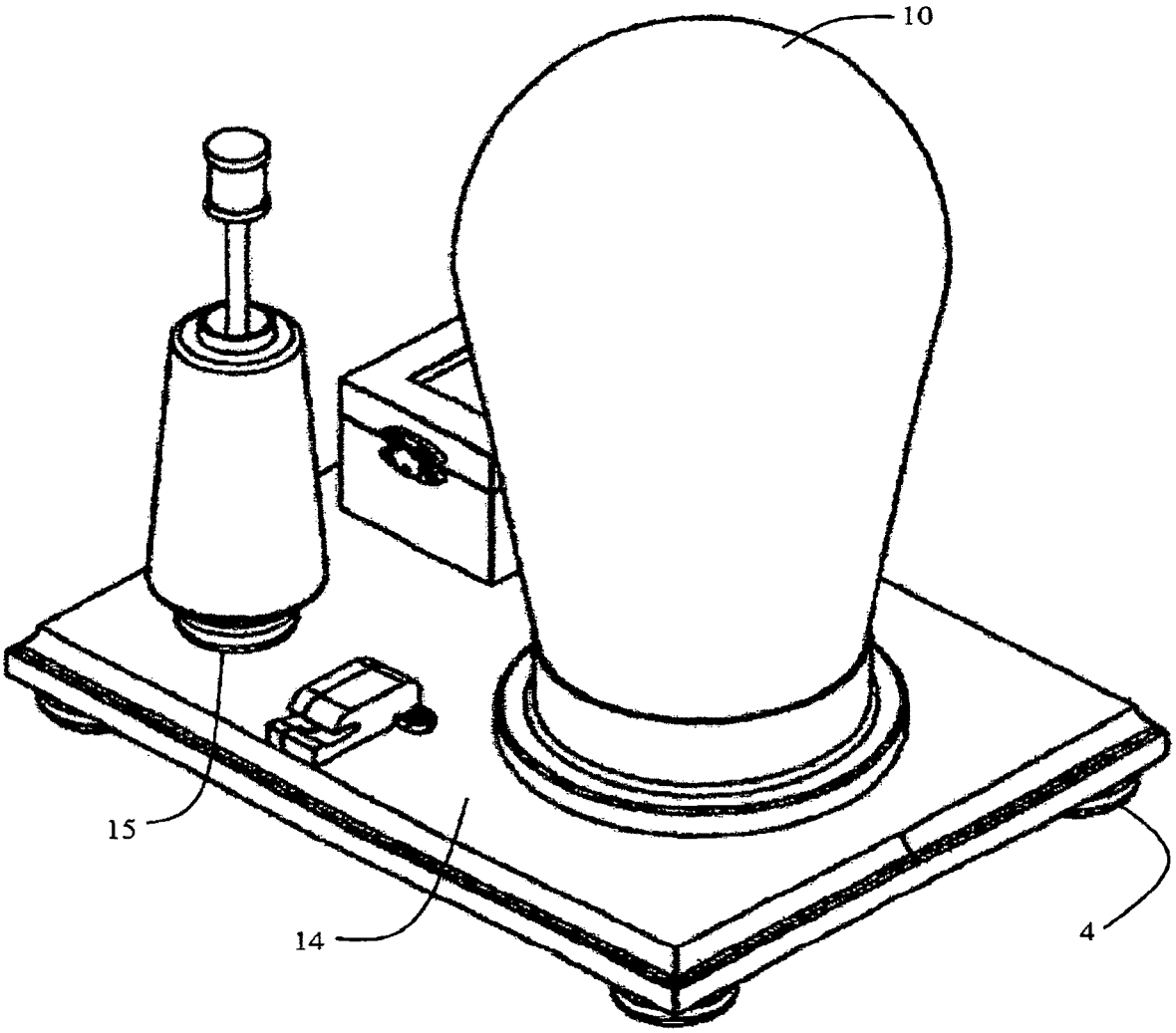
FIG. 1 is an elevation angled view of the weave assist area according to an embodiment of the present invention.
Figure 2:
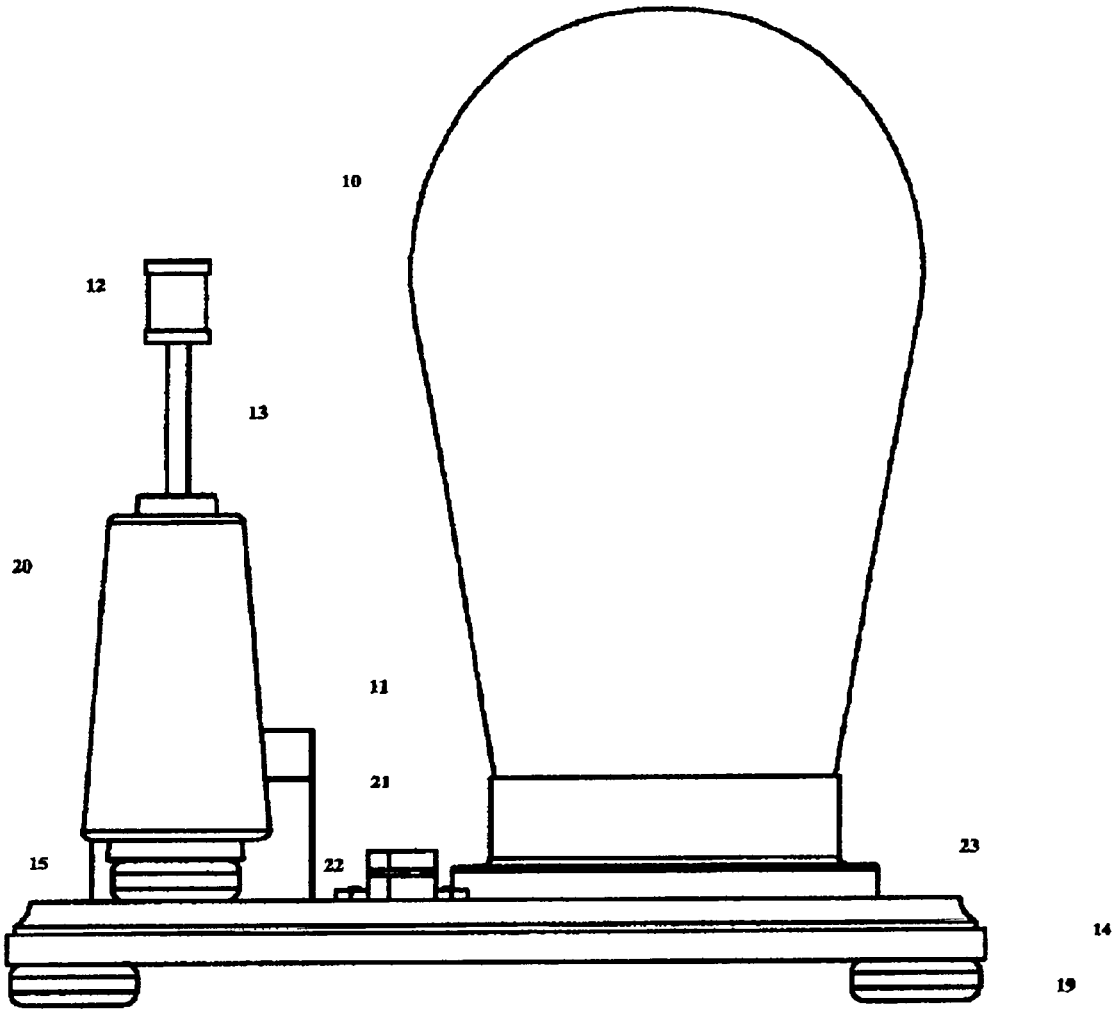
FIG. 2 is a front view of the weave assist system support structure illustrating feet placement, spool, head, simple blade, and storage box placement according to an embodiment of the present invention.
Figure 3:
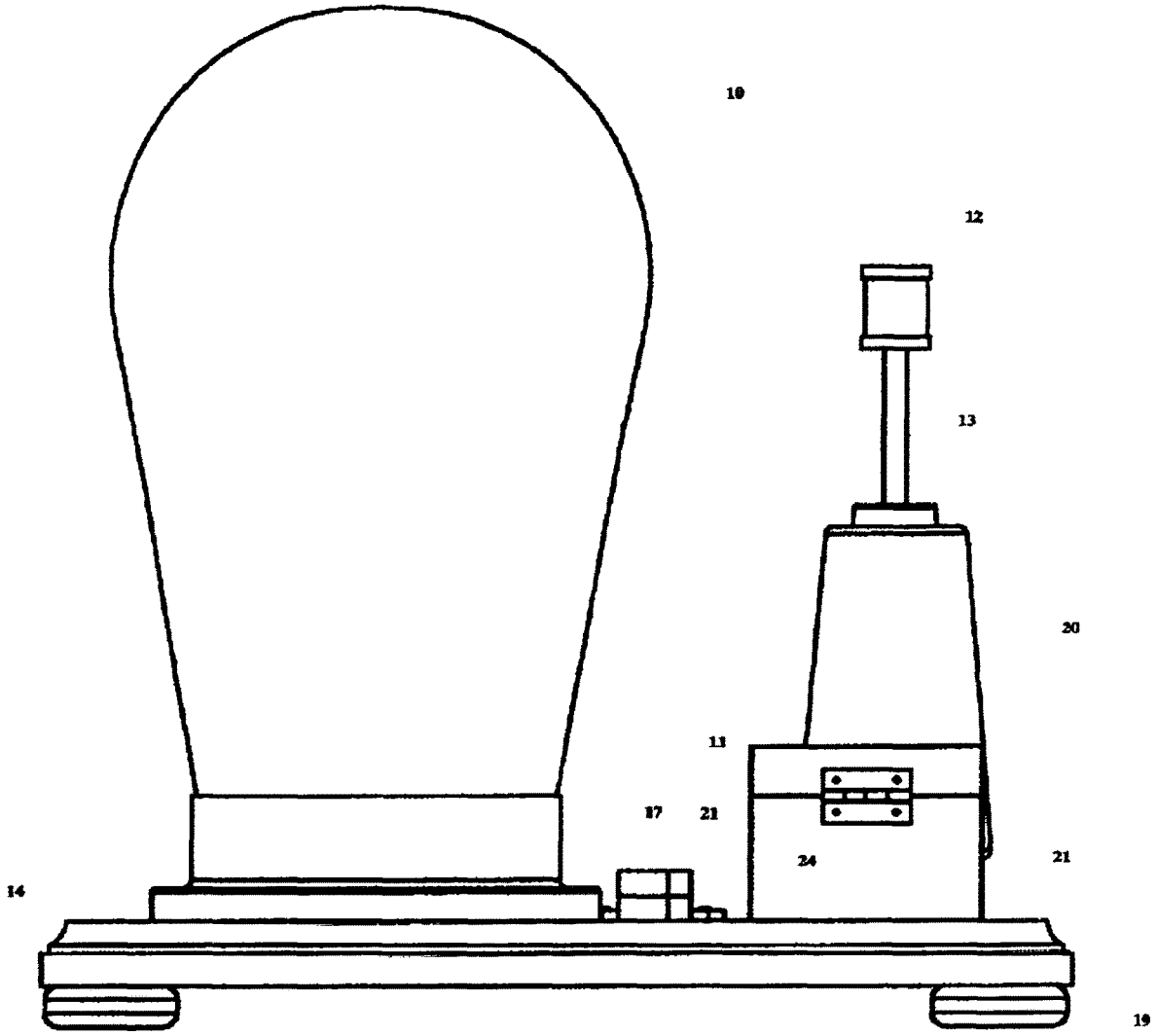
FIG. 3 is a back view of the control unit of FIG. 2 according to an embodiment of the present invention.
Figure 4:
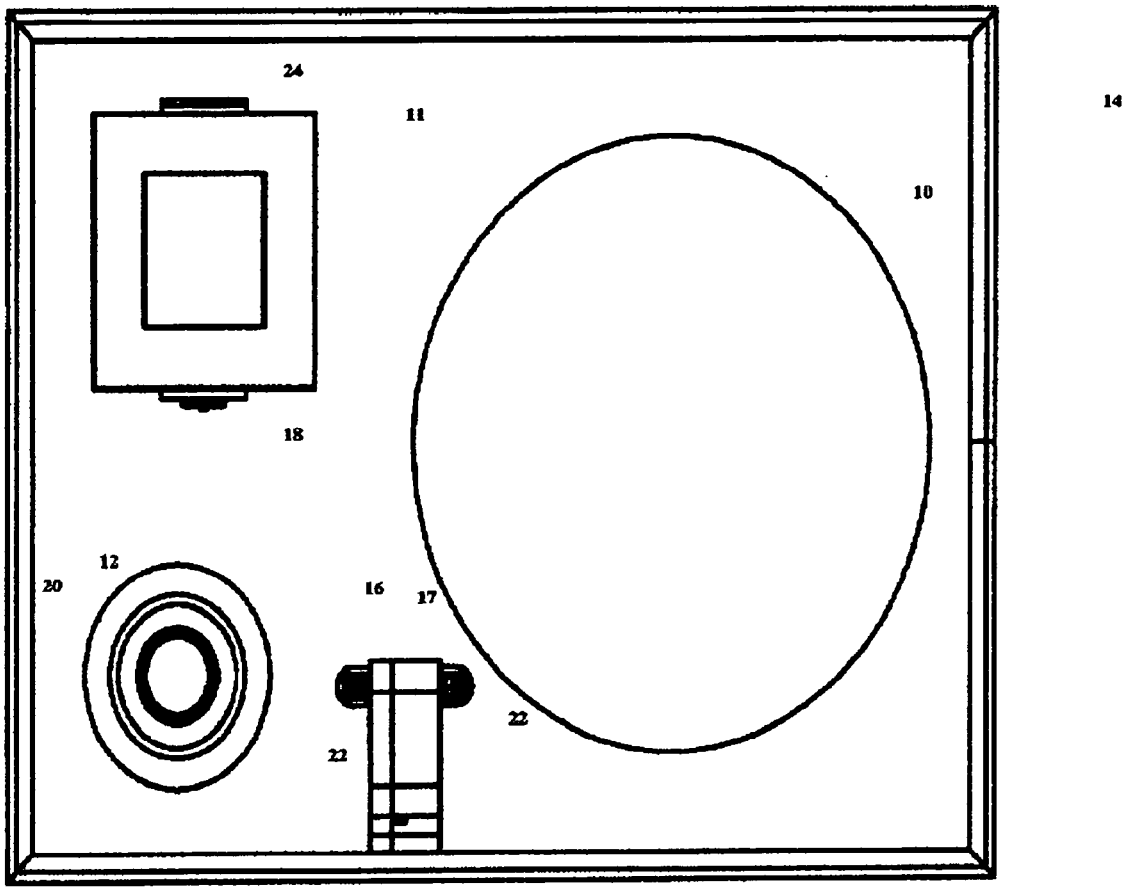
FIG. 4 is a top diagram of components of the control unit of FIG. 1,2,3 according to an embodiment of the present Invention.
Figure 5:
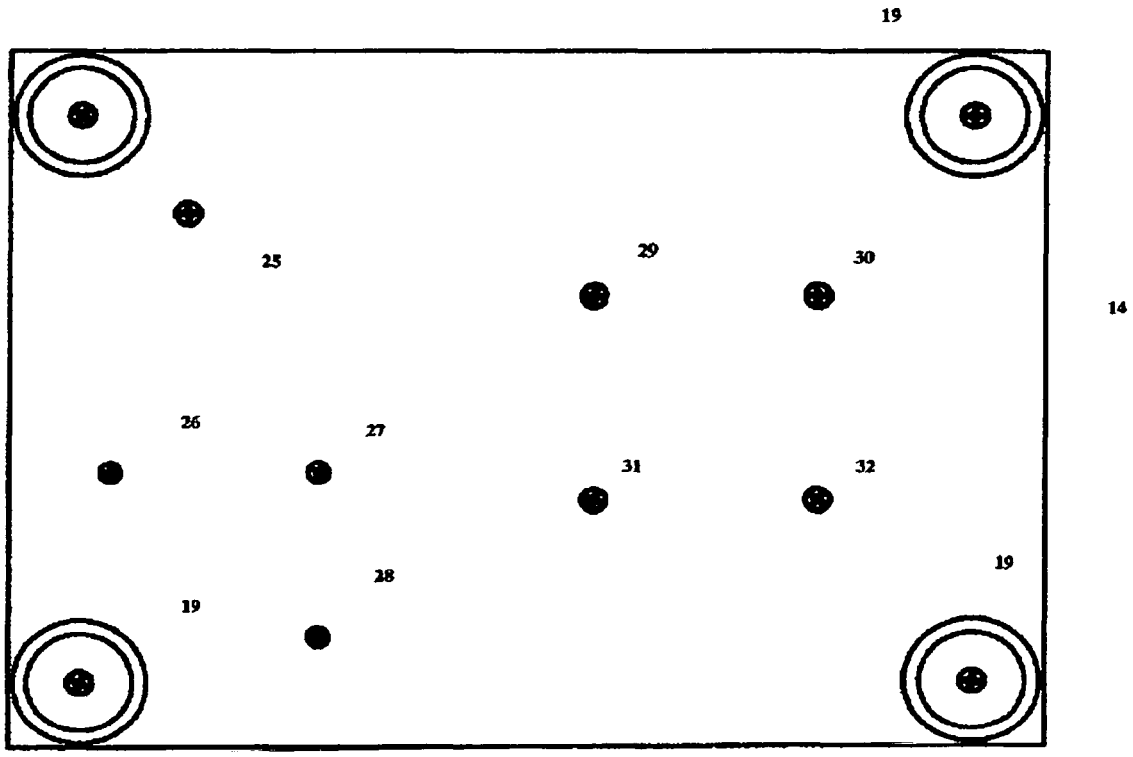
FIG. 5 is a bottom view of feet placement and screw alignments Illustrating for attaching all said components according to an embodiment of the present invention.
Figure 6:
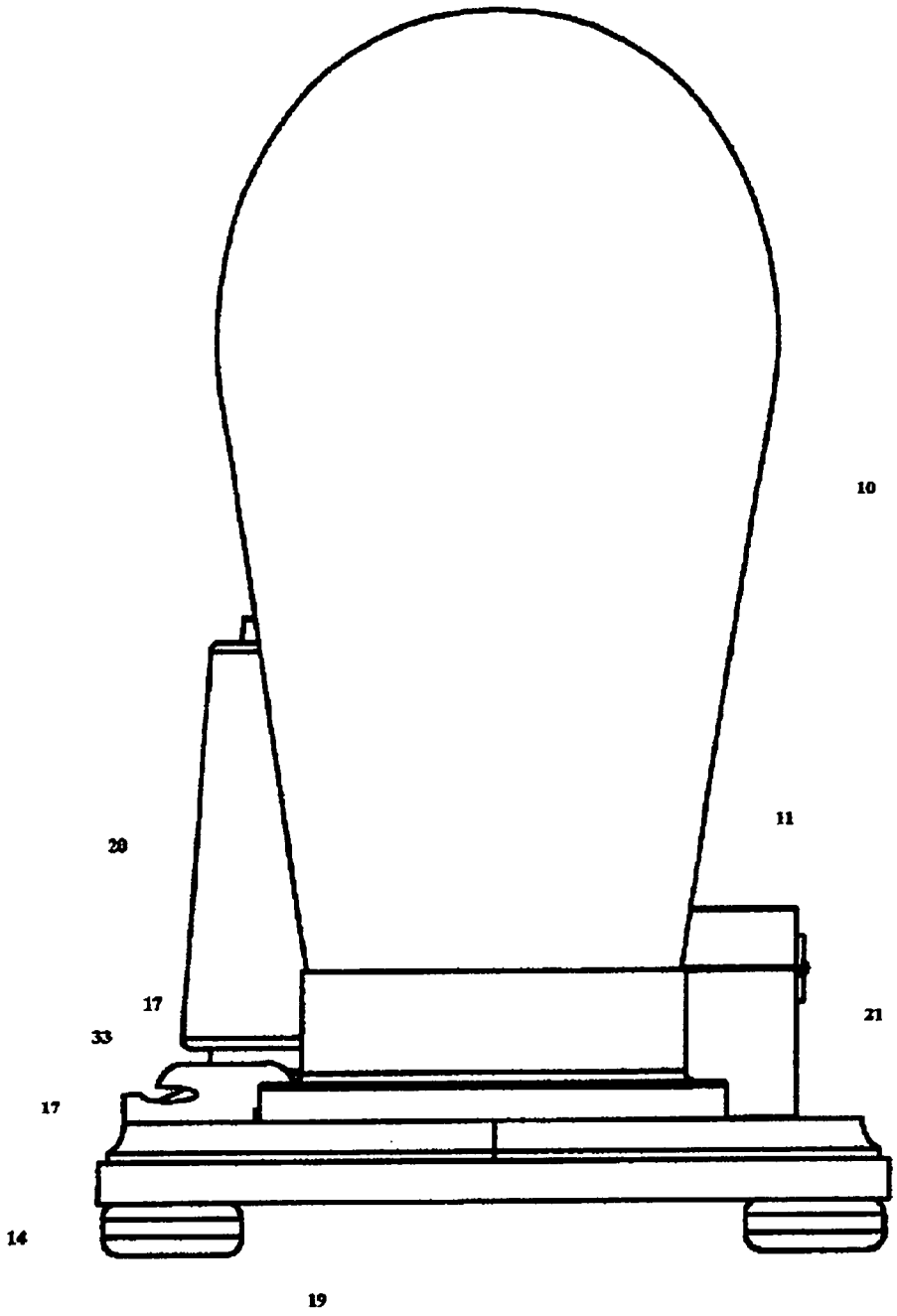
FIG. 6 is a right side view according to an embodiment of the present invention.
Figure 7:
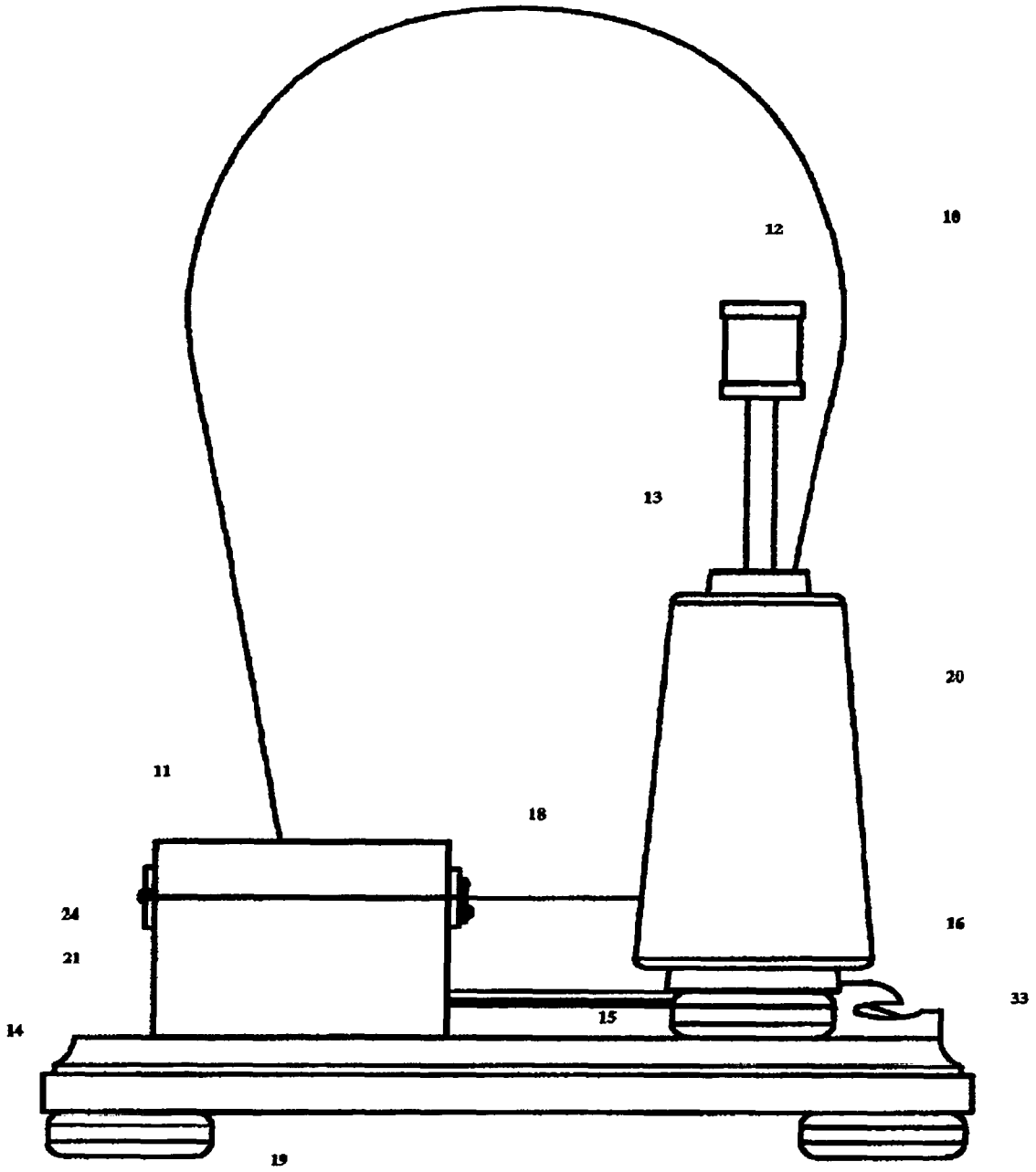
FIG. 7 is a left side view according to another embodiment of the present invention.

FIG. 1 is a view of the weave assist angled view showing the components on board the device. Standing or sitting right in front of the weave assist invention, you will see everything you need to complete your weaving job. The thread item 20 is vertically located on the spool holder 12, 13, and 15 respectively on the left hand side of the device. The simple blade Is made of 3 parts 16,17, and 33 located on the left of the block head part 10. For the greatest use, a flat surface or any solid surface will hold the device while working. It may been seen in FIG. 1 which is a representative of the art at the time of filing the present application, that such board 14 is rectangular in shape. Some may be rectangular, scalloped edges, or suitable product. The bottom feet 19 holds device. Block head 10, spool, spool holder 12, 13, 15, simple blade 16,17, 33, and storage box 11, 21 are used in the following descriptions of the embodiments of the present Invention, and are important aspects of the application of principles and enhancements of the invention. It Is to be understood, however that many peripherals and enhancements may be applied to only the weave assist invention. FIG. 2 shows the front view of The Weave Assist Invention. If you take your hand and twist 12, 13, and 15 forming the spool holder, it will remove the thread 20 and hold stick 12 and 13 to give the consumer more space to work once all needles are prepped. It was designed to cover all avenues in space and design needed for the overall invention use. FIG. 3 is a back view of the weave assist invention showing the hinge 24 on the back of the storage box and the back of the block head 10 located on the device. FIG. 4 shows the top view of the weave assist invention. The block head 10 is to the right of the device, simple blade 16, 17, and 33 next to it, followed by the spool holder 12 end 13, spool foot 15, and thread 20. Located behind the thread is the storage box 18, 11, 24, and 33 together. FIG. 5 shows the bottom base 14 of the weave assist invention with 4 circular feet 19 located on each corner and the screw placement for the components 25,28,27,28, 29, 30, 31, 32 located above the device. FIG. 8 shows the left side view of the block head 10 sitting on the middle right side of the device. Also showing the profile of the blade 17 and 33 with a view of the thread 20 and storage box 11,18,21 respectively. FIG. 7 shows the right side view of the storage box forming 11, 18, 24, 21 together, spool foot 15, spool holder forming 12, 13, and 15, and thread 20.

I claim:

1. An apparatus for assisting in the weaving of a wig, said apparatus comprising:

a flat base with a plurality of feet supporting said flat base;

a block head disposed on one side of the flat base for supporting a wig while preparing and installing weaves;

a spool holder, supporting a spool of thread on an opposite side of the base on which the block head is disposed;

a thread cutter disposed on the base between the spool holder and the block head, said thread cutting blade configured to cut thread at a desired length; and a storage box disposed on the base on the opposite side of the base, adjacent the spool holder, wherein the apparatus is configured to prep needles in a wig making process.

2. The apparatus for assisting in the weaving of a wig, according to claim 1, wherein the thread cutter comprises a protective blade housing holding a blade, wherein the protective blade housing comprises two halves that snap together forming a U-shaped opening in the protective blade housing for exposing a cutting edge of the blade, wherein said cutting edge of the blade is arranged at a 45 degree angle with respect to the flat base, and wherein a thread or hair weft is cut by pulling said thread or hair weft taut between two hands and pushing said thread or hair weft forward against the cutting blade.

3. The apparatus for assisting in the weaving of a wig, according to claim 1, wherein a spool and said spool holder are permanently attached to each other, and wherein said spool and said spool holder are configured to be removable from the flat base by pulling said spool and spool holder vertically up out of the flat base thereby allowing a user to change a thread or free up space on the flat base when making wig units.

4. The apparatus for assisting in the weaving of a wig, according to claim 1, wherein a thread or a hair weft from said spool holder extends across a front of the apparatus adjacent the thread cutter thereby allowing a user to cut the thread or the hair weft.

5. The apparatus for assisting in the weaving of a wig, according to claim 1, wherein the storage box comprises a top piece, bottom piece and a latch in the front attached to said top piece and said bottom piece, said latch configured to hold said top piece closed on said bottom piece.

6. The apparatus for assisting in the weaving of a wig, according to claim 1, wherein a bottom of each foot of the plurality of feet includes a non-slip material for improving the grip of the apparatus on a flat surface.

7. The apparatus for assisting in the weaving of a wig, according to claim 1, wherein the block head is made from high density plastic with high density Styrofoam encased in canvas.

* * * * *